US005930968A

United States Patent [19]

Pullam

[11] Patent Number: 5,930,968

[45] Date of Patent: Aug. 3, 1999

[54] INTERLOCKING STUBS

[76] Inventor: Billy D. Pullam, P.O. Box 21, Cottondale, Fla. 32431

[21] Appl. No.: 08/998,094

[22] Filed: Dec. 24, 1997

[51] Int. Cl.[6] ..... E04C 3/02

[52] U.S. Cl. ..... 52/481.1; 52/690; 52/729.1

[58] Field of Search ..... 52/481.1, 690, 52/281, 729.1, 729.4, 317

[56] References Cited

U.S. PATENT DOCUMENTS

| | | | |
|---|---|---|---|
| 3,332,188 | 7/1967 | Schaefer | 52/241 |
| 4,854,096 | 8/1989 | Smolik . | |
| 5,189,860 | 3/1993 | Scott | 52/729 |
| 5,203,132 | 4/1993 | Smolik | 52/690 |
| 5,394,665 | 3/1995 | Johnson | 52/241 |

*Primary Examiner*—Carl D. Friedman
*Assistant Examiner*—Dennis L. Dorsey
*Attorney, Agent, or Firm*—Carnes Conal Dixon

[57] ABSTRACT

The present invention is a wall framing system comprising upper beams, lower beams and a plurality of studs secured to the beams via a securing system. The securing system comprising a plurality of apertures located within the upper and lower beams. The studs include flanges extending outwardly and perpendicularly from there lower ends. The flanges are received within the apertures for providing the studs to be in a secured and fixed position. The studs are preferably made of plastic and include apertures for allowing wiring, plumbing and conduits to extend through each stud.

18 Claims, 2 Drawing Sheets

INTERLOCKING STUBS

BACKGROUND OF THE INVENTION

1. Field of the Invention

The present invention relates generally to interlocking studs and more particularly to an interlocking system used specifically for studs for enabling quick and efficient installation while reducing unnecessary costs and additional material for successfully building and constructing commercial and residential structures.

2. Description of the Prior Art

In construction, as in any business, efficiency, as well as operation costs are very consequential. Reducing time for construction, while not sacrificing structural integrity of a building, will inherently reduce labor, as a result reducing the overall construction costs. Thereby, many contractors will employ builders who are not only skilled, but who possess excellent time management skills to efficiently construct a structure.

Building material is yet another area of interest with building contractors. If materials can reduce costs and time associated with construction without affecting the structural integrity of the building, many will employ that material. One area of interest is the installation of studs typically used for forming the frame of the particular structure. Conventionally, the studs are fabricated from metal or wood, and can be tedious to install. The builder typically must take measurements for appropriately placing the stud and then utilizes self-tapping screws for securing to an upper frame member. This task can be extremely time consuming. Accordingly efforts have been made to reduce the time and costs generally associated with the installation of studs.

For example, in U.S. Pat. No. 4,854,096 issued to Smolik there is disclosed a wall assembly system which includes an upper and a lower horizontal support beam. The support beams each includes a channel including notches, evenly spaced and extending into the channel. The vertical stud is insertable in the channel of the horizontal support studs, and snaps into place when twisted into the notches. This system eliminates the use of nails and the like. Unfortunately, this system may be efficient during building, but manufacturing of the beams can be costly. The means of forming the notches within the upper and lower horizontal support beams can be expensive and tedious to the manufacture. In addition, the vertical support beams having a C-shape, and may fail to adequately offer the support needed for the structure. This shape may also be difficult to work with, since the user is limited to installing wiring and the like on solely one side of the vertical support stud.

Yet another stud wall framing system is disclosed in U.S. Pat. No. 5,394,665, issued to Johnson. In this patent there is disclosed a system comprising upper and lower horizontal support beams and a plurality vertical studs. The horizontal and vertical studs include a plurality of extrusions which will act as an interlocking means. The upper and lower section of each vertical stud include stud protrusion which are interlockable with the extrusions of the horizontal support beams. Though this system does eliminate the use of screws and the like, this system does include some shortcomings. To insert the vertical studs, the user merely forces it downward or upward to cause the channel of the beams to expand outward. This capability of expansion seems to reduce the structural strength of the beams. Further, these studs, like to Smolik, are C-shaped in configuration. This shape may cause some difficulties, making wiring and the like awkward and tedious.

Accordingly, it is seen that none of these previous efforts, provide the benefits intended with the present invention, such as providing a stud wall framing system which is not only efficient by does not sacrifice the structural integrity of the building. The prior techniques do not suggest the present inventive combination of component elements as disclosed and claimed herein. The present invention achieves its intended purposes, objectives and advantages over the prior art device through a new, useful and unobvious combination of component elements, which is simple to use, with the utilization of a minimum number of functioning parts, at a reasonable cost to manufacture, assemble, test and by employing only readily available material.

SUMMARY OF THE INVENTION

The present invention provides a system which will enable installation of horizontal beams and vertical wall studs, adequately, efficiently and without sacrificing the structural integrity of the building. In addition this system enables the installation of studs without utilizing additional hardware by providing for the studs to snap in place and not require the use of nails, screws, or the like. This system of the present invention includes horizontal and vertical support beams and a plurality of vertically disposed wall studs.

The horizontal and vertical support beams are designed and configured to receive the studs and include a locking means. Each beam is generally C-shaped in configuration thereby, having a lower planar wall, including an interior surface and an exterior surface. Side walls extend upward from the planar wall. These side walls are oppositely located and are parallel to each other. This upward extension inherently causes the formation of the interior of the beam.

Located on the interior surface of each side wall is a receiving means. These receiving means will receive the opposite ends of the studs for locking the stud in a fixed and secured position. Extending through the lower planar wall are a plurality of apertures. These apertures will receive screws or the like for securing the beams to the ceiling and/or floor of the particular structure.

The vertical studs are designed and configured to be twisted and locked in a secured position within each receiving means. The vertical studs include an elongated shaft having a substantially rectangular configuration. The rectangular shaped shaft includes oppositely located outer edges. Perpendicularly located on each edge is a planar wall. These walls each include a top end and a lower end. Secured to each top end and each lower end of the planar walls are locking means. The locking means is a flange which is perpendicularly displaced with respect to the wall to provide for the flange to extend outwardly from each wall.

The receiving means of the beams are apertures which extend through each side wall. These receiving means are designed and configured to receive the flanges which extend outwardly from the planar walls. Thereby, rendering the installation to merely require the user to insert the locking means into the receiving means. This step simplifies the process of installing frames and eliminates the need of other costly materials.

For increased accessibility and usability of the apparatus of the present invention, the planar wall of the stud can include a plurality of apertures. The apertures can receive wiring and the like which provides for a system which will further enhance its effectiveness.

To increase the structural integrity of the system, horizontal studs can be secured to the planar of the vertical stud. These horizontal studs, or horizontal supports are bars having opposite ends. The opposite ends include a securing means which is received within the apertures of the vertical shafts. The apertures within the studs are receiving means which receive and maintain the securing means. The securing means are extensions which extends outwardly and beyond the apertures. Operation is similar as with the use of the studs.

Adapters are also provide for allowing the system to be installed quickly and easily to sloped ceiling. The adapters are shaped as the studs, but are hollow. This hollow design will enable the unit to receive the top end of the stud. The adapter includes one end which is open and an opposite end which is sloped. This slope portion will contact the beam secured to the sloped ceiling. Such an angled end will provide a system which is easy and simple to install. This adapter further includes a locking means. The locking means is similar is shape, structure and function as the locking means secured to the stud of the system of the present invention.

To reduce costs and possibility increase the durability of the product, the beams and/or studs can be fabricated from plastic.

Accordingly, it is the object of the present invention to provide for a framing system of the present invention which will overcome the deficiencies, shortcomings, and drawbacks of prior framing systems and methods thereof.

Another object of the present invention is to provide a framing system which is easy to utilize, does not require additional screws, nails or the like for installation of studs, and which does not sacrifice the structural integrity of the building.

Yet another object of the present invention is to provide a framing system which is time efficient, economical, environmentally friendly and which will inherently increase safety by providing a product which is fire resistant.

Still a further object of the present invention, to be specifically enumerated herein, is to provide for a framing system in accordance with the preceding objects and which will conform to conventional forms of manufacture, be of simple construction and easy to use so as to provide a device that would be economically feasible, long lasting and relatively trouble free in operation.

Although there have been many inventions related to a framing systems, none of the inventions have become sufficiently compact, low cost, and reliable enough to become commonly used. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DESCRIPTION OF THE PREFERRED EMBODIMENTS

Figure 1:
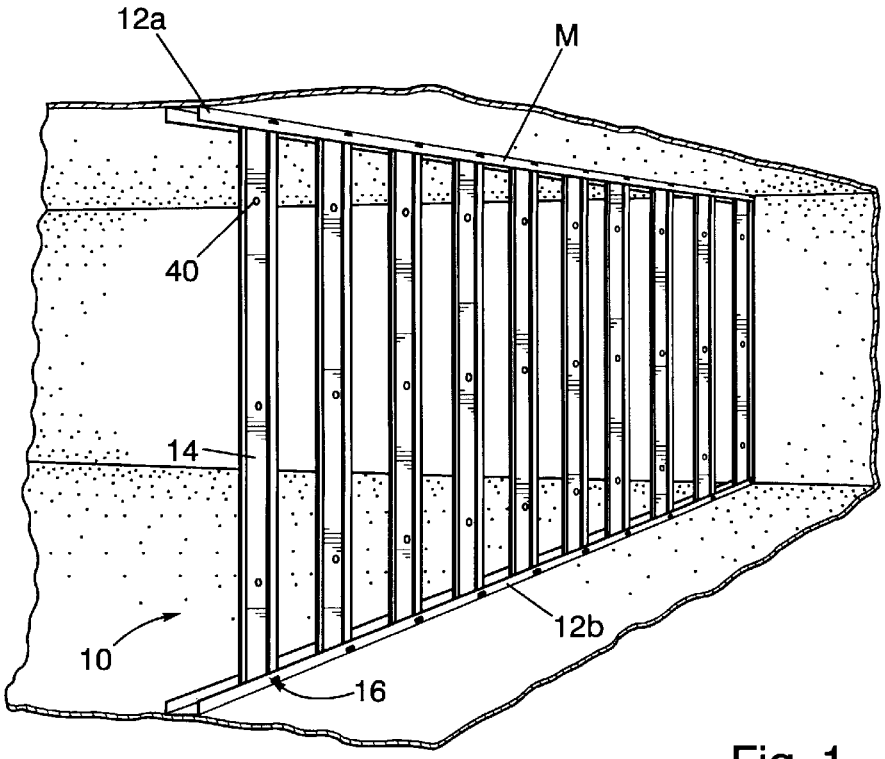
FIG. 1 is fragmentary perspective view of a stud wall framing construction using the present invention.

With reference to the drawings, in particular to FIGS. 1–4 thereof, the system of the present invention will be described. As seen in the drawings, the system 10 of the present invention comprises horizontal beams 12 and vertical studs 14. The upper horizontal beam 12*a* will be secured horizontally to a structural ceiling member M and the lower horizontal beam 12*b* will be secured horizontally to a structural floor member, illustrated, but not labeled. The studs will be located and received between the upper horizontal beam 12*a* and the lower horizontal beam 12*b*. The studs are locked into the beams via a locking means 16. The locking means 16 are located on each end of the stud. The locking means 16 of the studs are received and affixed to a receiving means 18 located in the horizontal beams.

Figure 2:
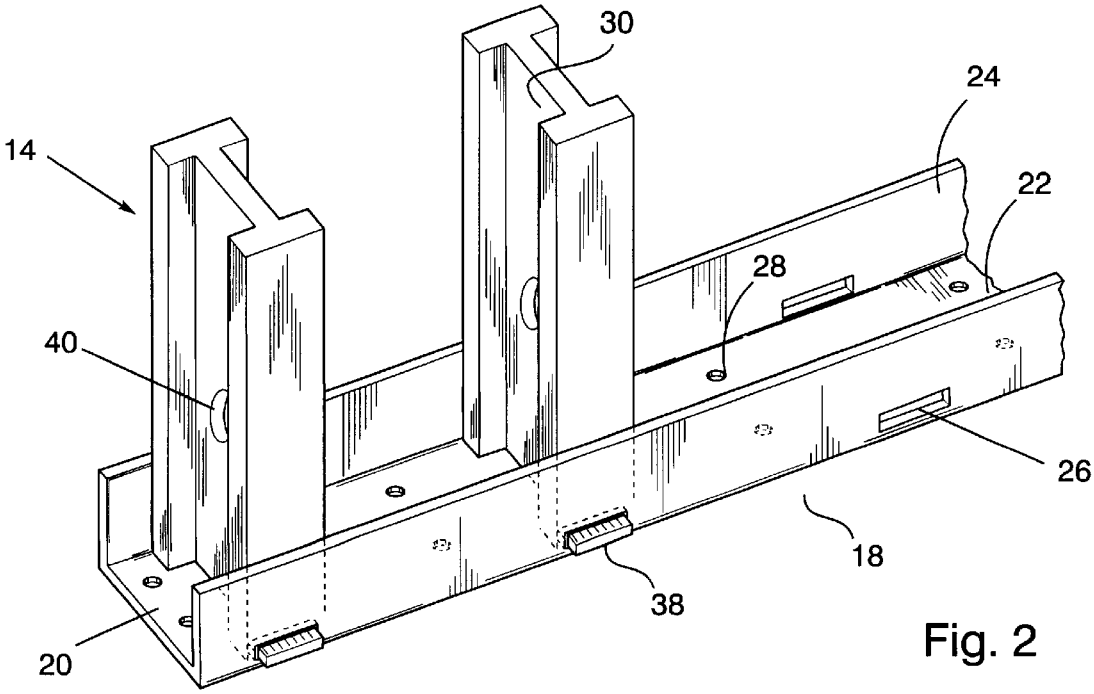
FIG. 2 is an enlarged fragmentary perspective view of a stud secured to the receiving means of the horizontal beam using the system of the present invention.

The upper and lower horizontal beams 12*a* and 12*b*, respectively, are substantially identical in configuration and thus are not separately illustrated. The lower beam 12 is illustrated in further detail in FIGS. 1 and 2. As seen in these figures, the beam 12 include a planar wall 20 having an exterior surface and an interior portion 22. The exterior surface will be secured to the structural member, M, as shown in FIG. 1. The interior portion 22 will receive and maintain the studs 14, as shown in FIGS. 1 and 2.

The planar wall 20 includes opposite edges. Extending upwardly from each edge is a side wall 24. The side walls 24 are oppositely displaced and are parallel to each other. Located in proximity to the lower area of the side wall are receiving means 18. The receiving means 18 are a plurality of slots 26 which will receive and maintain the locking means.

For securing the horizontal beam to the support surface, ceiling or floor, a plurality of apertures 28 extend through the planar wall 20. These apertures 28 will allow for screws, nails or the like to extend therethrough and secure the device to the appropriate surface.

Figure 3:
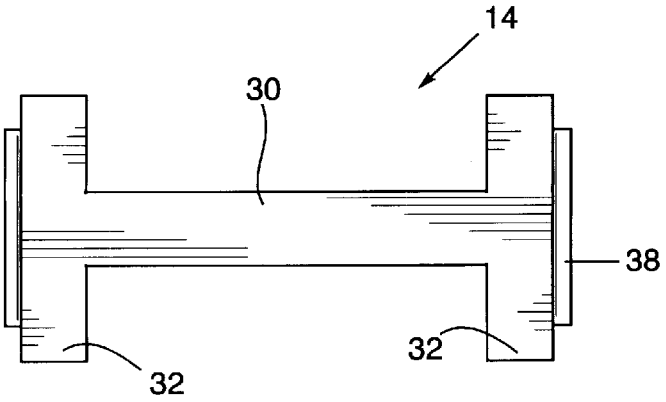
FIG. 3 is a bottom view of the stud including the locking means for the system of the present invention.

The vertical studs 14, as seen in FIGS. 1–4, are elongated and includes a central, yet substantially flat, rectangular shaft 30. The shaft includes opposite outer edges wherein each edge includes an outer wall 32. The outer walls 32 are perpendicular to the shaft to provide for the cross-sectional view or top view to be substantially I-shaped, as illustrated in FIG. 3.

As seen in FIGS. 1–4, the studs further include an upper end 34 and a lower end 36. Extending outwardly from each end is a flange or tongue 38. This flange or tongue 38 extends perpendicularly from the outer walls 32 of the stud 14. This flange or tongue 38 constitutes the locking means 16 to provide for this portion to be received and maintained within the receiving means or the slots 26 of the horizontal beams. As seen in the figures, the locking means 16 extends outwardly from the side wall 24. As also seen in the figures, this flange is affixed to the side wall of the stud to provide for the attaching means and tongue to be an integral structure. This integral structure adds to the structural strength of the overall product.

In use, the receiving means 18, which are illustrated as slots 26, are designed and configured to receive the flanges or tongues. Once in place, the studs will be in a locked in a secured position. For installation, the user merely inserts the stud into the interior of the horizontal beams 12. The flanges 38 will face away from the slots 26. To secure the stud in place, the user twists the stud, forcing the tongue 38 into the receiving means 18. Once located therein, the stud will be in a fixed and secured position. Such a design inherently provides a system which eliminates the need of additional equipment and hardware, such as hammers, nails, screws, or the like, for proper installation. The dry wall be installed on the flange or tongue.

For increased accessibility and usability of the apparatus of the present invention, the planar wall of the stud can include a plurality of apertures 40. The apertures 40 can receive wiring, plumbing, and the like which provides for a system which will further enhance its effectiveness.

Figure 5:
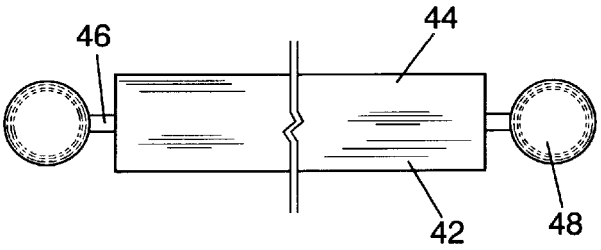
FIG. 5 is a side view of a horizontal brace used with the system of the present invention.
Figure 4:
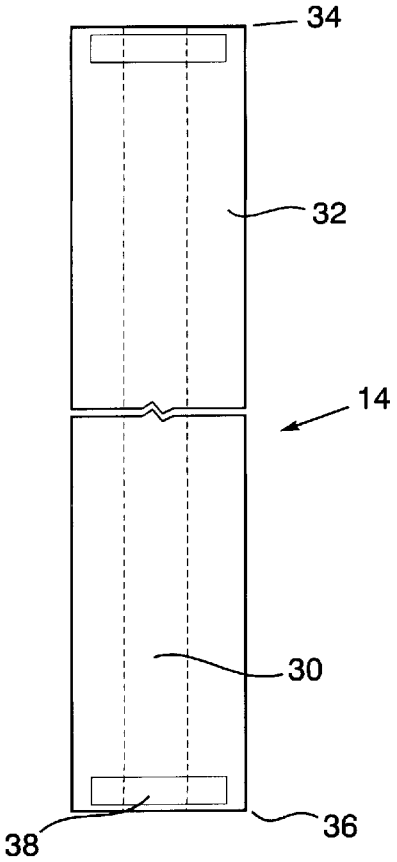
FIG. 4 is a side view of the stud used with the system of the present invention.

To increase the structural integrity of the system, horizontal braces 42 can be secured to the planar wall 30 of the vertical stud 14. These horizontal braces 42, or horizontal supports, are illustrated in further detail in FIG. 5. As seen in this figure, the horizontal braces 42 are bars including a shaft 44 having opposite ends. The opposite ends include a securing means 48 which are spaced by an extender 46. The securing means 48 is received within the apertures 40 of the vertical shafts 14. This design and configuration provides, like the vertical studs, to be installed without the use of tools, nails, screws, or the like.

As such, the securing means 48 will snap into place through the apertures 40 of the vertical studs 14. Thereby, providing for the extenders 46 to be located within the apertures 40. In order to achieve this action, the securing means are extensions which extends outwardly from the opposite ends of the horizontal shaft 44 and which are secured via the extender 46. The extensions are preferably round in shape. This round shape will produce a product which is easy to insert, using a minimal amount of force, yet will extend through the apertures while enabling the extender to be located therein. Due to its diameter, removal of the securing means will be difficult. Hence, installation will be efficient and successful.

Accordingly, to utilize the system of the present invention, the frame is first installed. For forming the frame, horizontal beams 12 are used. The flat planar walls 20 of the beams are secured to the desired surface, such as the floor or ceiling M. Securement is accomplished by extending conventional securing means, such as screws or the like, into the apertures 28 located in the flat planar wall. The side walls 24 will extend either upwardly, if secured to the floor, or downwardly, if secured to a ceiling.

The desired studs are selected. Once selected, the flange or tongue 38 is inserted and snapped into the receiving means or aperture 26 for providing each stud to be in a locked and secured position. Once all the studs are secured to the beams, the braces 42 can be inserted therein.

Adapters are also provided for allowing the system to be installed easily and efficiently to sloped or angled ceiling, which conventionally, can be difficult and burdensome. The adapters 50 are hollow and have substantially the same shape and configuration as the vertical studs discussed above.

Figure 6:
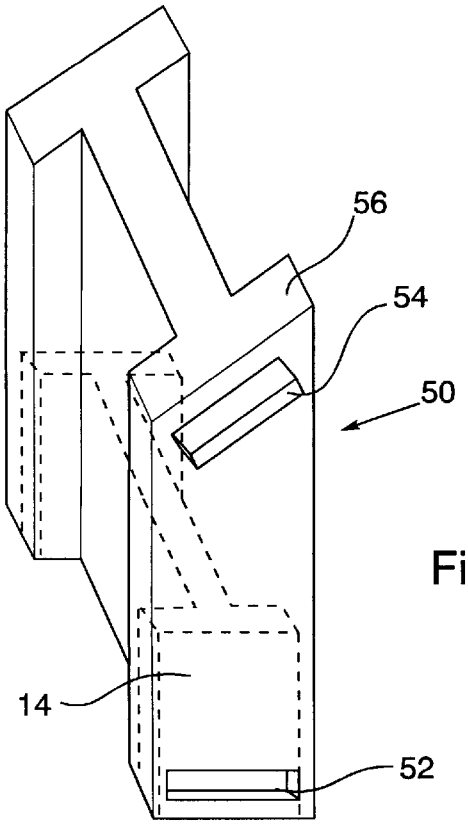
FIG. 6 is a side view of an extender/adapter for retrofitting the stud of the present invention for use on a slanted or sloped ceiling.

The adapter 50 is illustrated in further detail in FIG. 6. As seen in this figure, the adapter 50 includes a hollow body that will slide over the top of the vertical stud of the present invention. As such, the adapter includes an opened lower section for slidably allowing the stud 14 (illustrated in outline) to be located therein. Also located in the lower section of the adapter 50 is an opening 52. This opening will allow for the tongue to extend therethrough and will also provide for the adapter to be secured to the vertical stud. Once the tongue is located within the opening, it will be secured thereon.

The top end 56 of the adapter includes a tongue 54 which will enable it to be secured to the sloped ceiling beam. This will permit for the vertical stud to be secured easily and quickly.

For allowing such an attachment, the top end 56 of the adapter 50 is sloped. This will provide for the stud to adapt to the slope ceiling.

In order to use the adapter of the present invention, the user attached the open end to the existing vertical stud of the present invention, illustrated in FIGS. 1–4 thereof. The attaching means of the stud will extend through the opening 52 of the adapter 50. This will guarantee that the adapter is secured to the vertical stud. Securing the stud with the adapter attached thereto is similar as discussed above when securing the studs to the beams.

The studs and beams can be fabricated from any desirable material, such as wood, steel, plastic or the like. Preferably the studs are fabricated from plastic to reduce costs. Constructing the studs and its respective components may possibly provide the studs to inherently include fire retardant characteristics as well as produce studs with sufficient decrease in weight, yet no alteration in structural integrity. Additionally, the studs can be fabricated from any size, such as but not limited to, 2 ft.×4 ft., 2 ft.×2 ft., 2 ft. by 6 ft., or 2 ft. by 8 ft. The dimensions listed above are the dimensions utilized for conventional studs. The studs and beams as described above are ideal for use with interior walls.

While the invention has been particularly shown and described with reference to an embodiment thereof, it will be understood by those skilled in the art that various changes in form and detail may be made without departing from the spirit and scope of the invention.

I claim:

1. An interlocking system comprising:

a plurality of vertical studs having a top end and a lower end;

said top end and said lower end each have a locking means;

a top beam and a lower beam;

said top beam and said lower beam each include a second locking means being corresponding to said locking means for rending said plurality of vertical studs to lock into place when secured to said top beam and said lower beam;

each of said plurality of vertical studs includes a planar wall and a pair of side walls perpendicularly secured to said planar wall;

said locking means is a flange extending perpendicularly and outwardly from each side wall and said second locking means is an opening for receiving said flange; and said flange is integral with said side walls of said stud.

2. An interlocking system as in claim 1 further includes a plurality of horizontal braces secured between said plurality of studs, said horizontal braces are secured to said plurality of studs via a securing means, said securing means are extenders which extend outwardly from opposite ends of each horizontal brace, said extenders have a width which is larger than said horizontal brace and said planar wall of each of said plurality of studs include a plurality of apertures for receiving said extenders.

3. An interlocking system as in claim 1 wherein a plurality of apertures extend through each planar wall of said plurality of studs for enabling wiring and conduit to extend therethrough.

4. An interlocking system as in claim 1 wherein said plurality of vertical studs have an I-shape, wherein said side walls are centrally secured to said perpendicular planar wall.

5. An interlocking system as in claim 1 wherein said top beam and said lower beam each includes a flat planar wall having opposite edges, extending upwardly from each end is a wall, each wall includes said second locking means.

6. An interlocking system as in claim 1 wherein said plurality of studs are fabricated from plastic.

7. An interlocking system as in claim 1 further comprising a plurality of hollow adapters, each of said plurality of adapters includes an open bottom and an enclosed top, said open bottom is removably secured to said top end of said stud via an attaching means, said enclosed top is sloped, and exteriorly secured to said enclosed top are a second set of flanges for securing said top enclosed top of said adapters to said top beam.

8. An interlocking system comprising:

a plurality of vertical studs having a top end and a lower end;

said top end and said lower end each have a locking means;

a top beam and a lower beam;

said top beam and said lower beam each include a second locking means being corresponding to said locking means for rending said plurality of vertical studs to lock into place when secured to said top beam and said lower beam;

each of said plurality of vertical studs includes a planar wall and a pair of side walls perpendicularly secured to said planar wall;

said locking means is a flange extending perpendicularly and outwardly from each side wall and said second locking means is an opening for receiving said flange; and a plurality of horizontal braces are secured between said plurality of studs;

said horizontal braces are secured to said plurality of studs via a securing means;

said securing means are extenders which extend outwardly from opposite ends of each horizontal brace;

said extenders have a width which is larger than said horizontal brace;

a plurality of apertures extend through said planar wall of each of said plurality of studs for receiving said extenders.

9. An interlocking system as in claim 8 wherein top beam and said lower beam include a plurality of apertures for enabling securement to an upper or lower structure.

10. An interlocking system as in claim 8 wherein said plurality of vertical studs have an I-shape, wherein said side walls are centrally secured to said perpendicular planar wall.

11. An interlocking system as in claim 10 wherein said flange is integral with said side walls of said stud.

12. An interlocking system as in claim 11 wherein said top beam and said lower beam are each C-shaped.

13. An interlocking system as in claim 12 wherein said top beam and said lower beam each includes a flat planar wall having opposite edges, extending upwardly from each end is a wall, each wall includes said second locking means.

14. An interlocking system as in claim 8 wherein said top beam and said lower beam each includes a flat planar wall having opposite edges, extending upwardly from each end is a wall, each wall includes said second locking means.

15. An interlocking system as in claim 8 wherein said plurality of studs and said horizontal braces, including said extenders, are fabricated from plastic.

16. An interlocking system as in claim 15 where in said top beam and said lower beam are fabricated from plastic.

17. An interlocking system as in claim 8 wherein said extenders have a round shape.

18. An interlocking system as in claim 8 further comprising a plurality of hollow adapters, each of said plurality of adapters includes an open bottom and an enclosed top, said open bottom is removably secured to said top end of said stud via an attaching element, said enclosed top is sloped, and exteriorly secured to said enclosed top are a second set of flanges for securing said top enclosed top of said adapters to said top beam.

* * * * *